United States Patent [19]

Bohl

[11] 4,019,356

[45] Apr. 26, 1977

[54] APPARATUS FOR THE COLD WORKING OF BAR STOCK

[76] Inventor: Hans-Erich Bohl, D-3559 Grusen No. 66, Bemunden, Wohra, Germany

[22] Filed: July 22, 1975

[21] Appl. No.: 598,510

[30] Foreign Application Priority Data

July 24, 1974 Germany ..... 2435534

[52] U.S. Cl. ..... 72/30; 72/175; 72/299; 72/371; 72/442; 72/125

[51] Int. Cl.[2] ..... B21D 11/14

[58] Field of Search ..... 72/112, 125, 146, 149, 72/170, 173, 175, 299, 301, 371, 442, 30; 29/560

[56] References Cited

UNITED STATES PATENTS

| | | | |
|---|---|---|---|
| 2,501,241 | 3/1950 | Shaw | 72/175 |
| 3,067,800 | 12/1962 | Gogan | 72/299 |
| 3,182,480 | 5/1965 | DiMenichi et al. | 72/299 |
| 3,380,279 | 4/1968 | Lang | 29/560 |
| 3,769,836 | 11/1973 | Heldenbrand | 72/299 |
| R8,032 | 1/1878 | Shortau | 72/299 |

*Primary Examiner*—Lowell A. Larson
*Attorney, Agent, or Firm*—Fred Philpitt

[57] ABSTRACT

A machine bed supports stationary and rotary fixing means that are aligned for receiving bar stock therebetween. Electrical or electromechanical control means are provided for selecting and effecting, via a motor-driven step-down gear, exactly a predetermined amount of rotation of the rotary fixing means. Various detachable matching pieces hold opposite portions of the bar stock within the stationary and rotary fixing means, respectively, while the material is worked. Openings in the matching pieces positively fit the bar stock. The outer contour of the matching pieces permits insertion in the stationary and rotary fixing means for positive fit therein. A preferred embodiment of the apparatus serves the purpose of cold twisting square steel bars either singly or, for obtaining volutes, in bunches. Removal of worked bar stock is facilitated by a handwheel enabling the operator to manually counter-rotate the rotary fixing means by a selected small angle. A slide may be mounted on the machine bed for supporting two bending rollers whose position relative to each other and to a pulling roller engaged in the rotary fixing means can be adjusted as required for feeding and working bar stock between the bending and pulling rollers. For twirling the bar stock, a disk device carrying a plying tool and a self-locking excenter may be inserted in the rotary fixing means.

42 Claims, 17 Drawing Figures

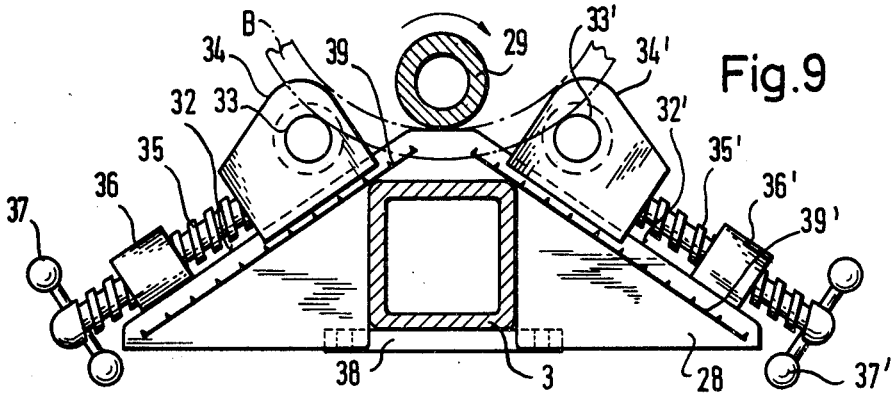
Fig.9
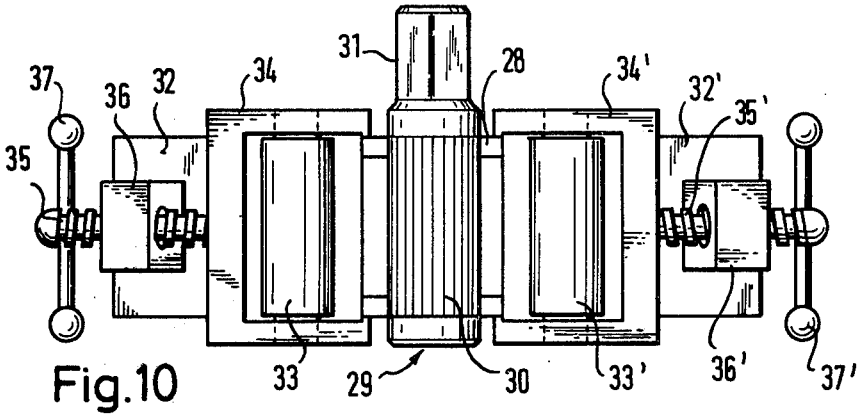
Fig.10
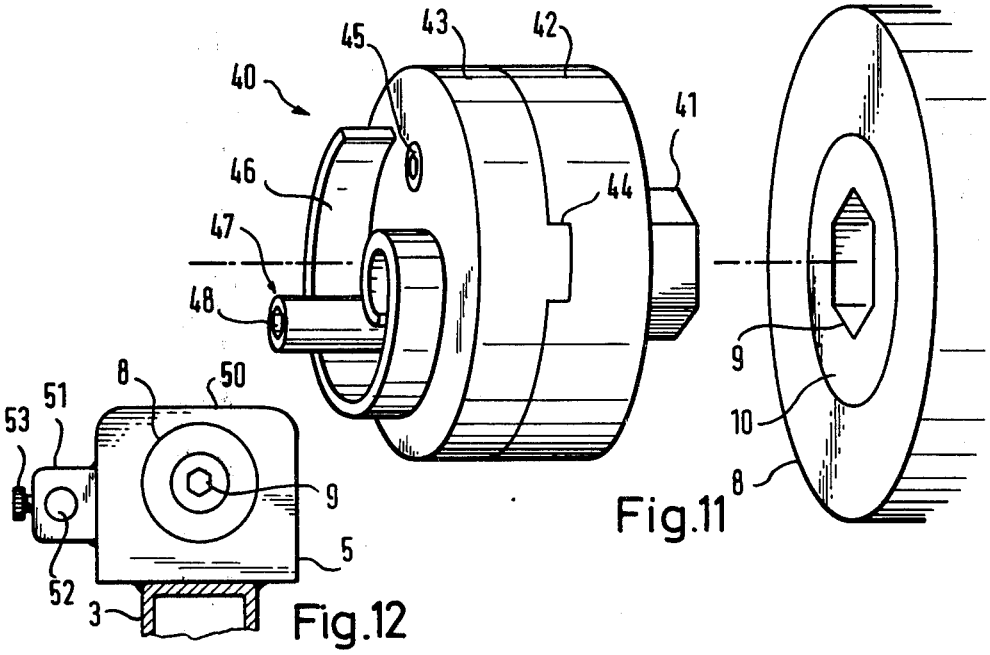
Fig.11
Fig.12

APPARATUS FOR THE COLD WORKING OF BAR STOCK

FIELD OF THE INVENTION

The invention relates to the cold working of bar stock, especially of forged steel or wrought iron, and more particularly to a novel apparatus for twisting, twirling and/or bending bars of various sections.

An important application of the invention is the cold working of bar stock for ornamental purposes, such as for railing banisters. However, the apparatus of the invention is not restricted to such application or to the cold working of the above-mentioned materials.

BACKGROUND OF THE INVENTION

Machines for the cold working of bar stock have been known. For example, bars of round or profiled section have been clamped in a stationary fixture on the one hand and in a rotary chuck on the other hand, the fixture and chuck being attached to the machine bed in a suitable manner and having jaws that are coupled to a continuous drive by a clutch to be engaged are required. In a conventional machine of this type, a shifting device is employed for disengaging the clutch. A linkage is provided between a selector fork and a thrust member for actuation. In order to disengage the clutch, the shifting device which is guided along cheek bars must be returned manually into its initial position. This design is rather complex, involving a heavy structure. It is, moreover, prone to misoperation and to deterioration because of inevitable wear and tear of the shifting device that is exposed to excessive strain.

The use of another conventional bar twisting machine is also impeded by a complicated construction. For drawing a bar during twisting, a longitudinally movable gripper is operated by a double action fluid cylinder whose control must be combined with an electric motor drive for a rotary chuck. Manufacture of such a heavy machine is expensive. In addition, the apparatus requires a large space and considerable skill on the part of the operator.

OBJECTS OF THE INVENTION

It is an important object of the invention to eliminate the drawbacks of the prior art and to provide an improved apparatus for the cold working of bar stock, particularly of cut stock that is to be shaped according to a predetermined pattern.

The invention further aims at providing an improved apparatus of this type of simple and rugged design, yet easy control and high performance.

Another object of the invention consists in providing an improved apparatus for the cold working of bar stock in an economical way, permitting rapid and accurate operation.

Still another object of the invention is the provision of a relatively light-weight apparatus for cold working stock of large section, especially for twisting, twirling and bending profiled bars.

Yet another object of the invention consists of providing an improved apparatus for the cold working of bar stock allowing safe operation, comfortable servicing and minimum maintenance.

SUMMARY OF THE INVENTION

In an apparatus for the cold working of bar stock, the invention provides a bed supporting stationary fixing means and rotary fixing means being aligned and arranged for variable spacing with respect to each other and being provided each with detachable insertion means having a profile being provided for effecting a predetermined amount of rotation of said rotary fixing means relative to said stationary fixing means, whereby one bar portion is held stationary while an opposite bar portion is wound in a predetermined degree.

Preferably, said rotary fixing means include a chuck disk with a shaped central hole for receiving said detachable insertion means, the latter comprising matching pieces each having a through hole matching the bar stock to be worked and further having a peripheral configuration matching the shape of said central hole which may be a polygon.

Further in accordance with the invention, said stationary fixing means may include a yoke aperture for receiving said detachable insertion means which may comprise profiled insets having sockets matching a bar to be twisted and further having a peripheral configuration matching the shape of said yoke aperture.

An important embodiment of the invention provides control means that comprise electromechanical means governing said motor drive for said rotary fixing means, selection means being provided for selecting said predetermined amount of rotation of said rotary fixing means. Preferably, said control means are adapted to respond only to said selection means being set for a predetermined amount of rotation. Electromechanical control means may include at least one cam for actuating a limit switch in order to stop said motor drive upon completion of said predetermined amount of rotation of said rotary fixing means. Said cam may be arranged for adjustment in a circumferential direction of said rotary fixing means. Further, a relay circuit may be provided that is adapted to be operated, by means of separate controls, for forward and reverse run of said motor drive, a circuit breaker being provided for effecting the stop of said motor drive upon the final preselected actuation of said limit switch by said cam. Alternatively, said control means may include timing means for selecting and effecting said predetermined amount of rotation of said rotary fixing means, preferably comprising a timer having interchangeable control elements for adaption to the speed of said motor-driven gear.

In a preferred embodiment of the invention, a handwheel is provided at the shaft of said motor for manually advancing and moving backward said rotary fixing means in order to facilitate removal of worked bar stock.

Still another embodiment of the invention includes a slide to be mounted on the machine bed for supporting two bending rollers whose position relative to each other and to a pulling roller engaged in the rotary fixing means can be adjusted as required for feeding and working bar stock between the bending and pulling rollers.

For twirling the bar stock, a disk device carrying a pyling tool and a self-locking excenter may be inserted in the rotary fixing means, said disk device preferably consisting of receiver and base disks detachably interconnected by keying and locking means.

BRIEF FIGURE DESCRIPTION

Further objects, features and advantages of the invention appear from the following detailed description given below, taken in connection with the accompanying drawings which form a part of this specification and which illustrate, by way of example, preferred embodiments of the invention.

Figure 3:
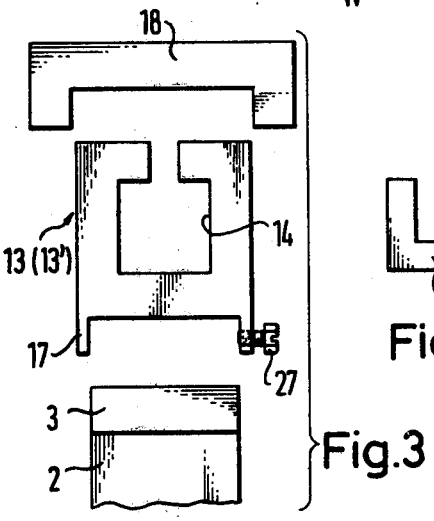
FIG. 3 is a simplified exploded front view of a stationary fixture.
Figure 4A:
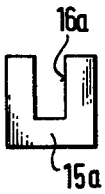
Figure 4B:
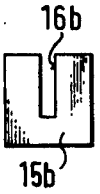
Figure 4C:
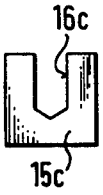
Figure 6A:
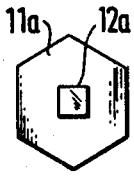
Figure 6B:
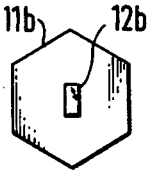
Figure 6C:
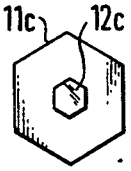
Figure 5:
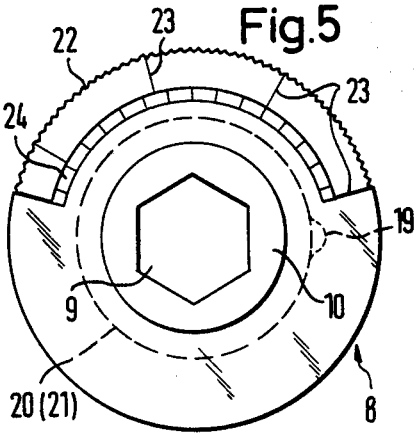
Figure 7:
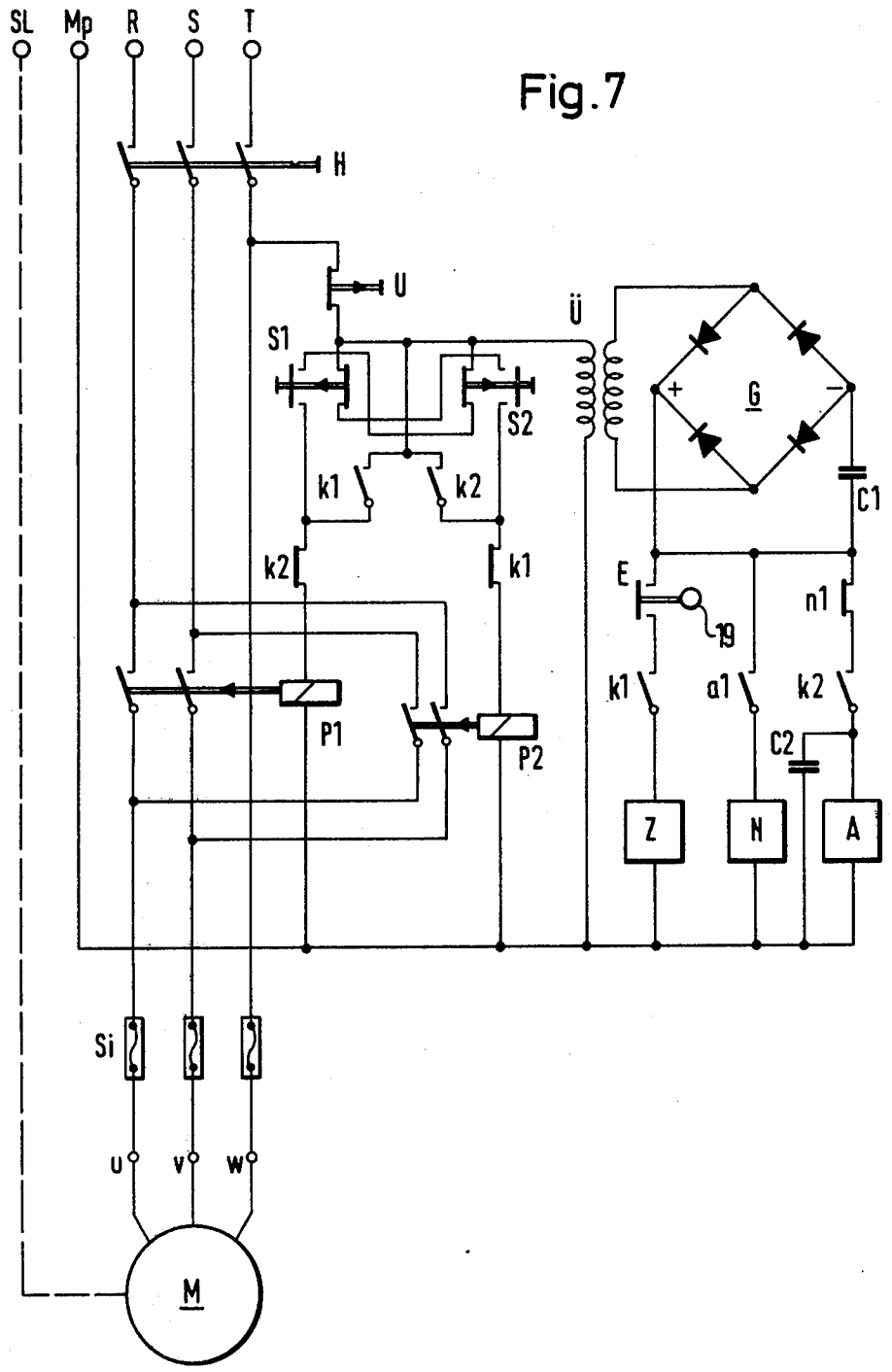
Figure 8:
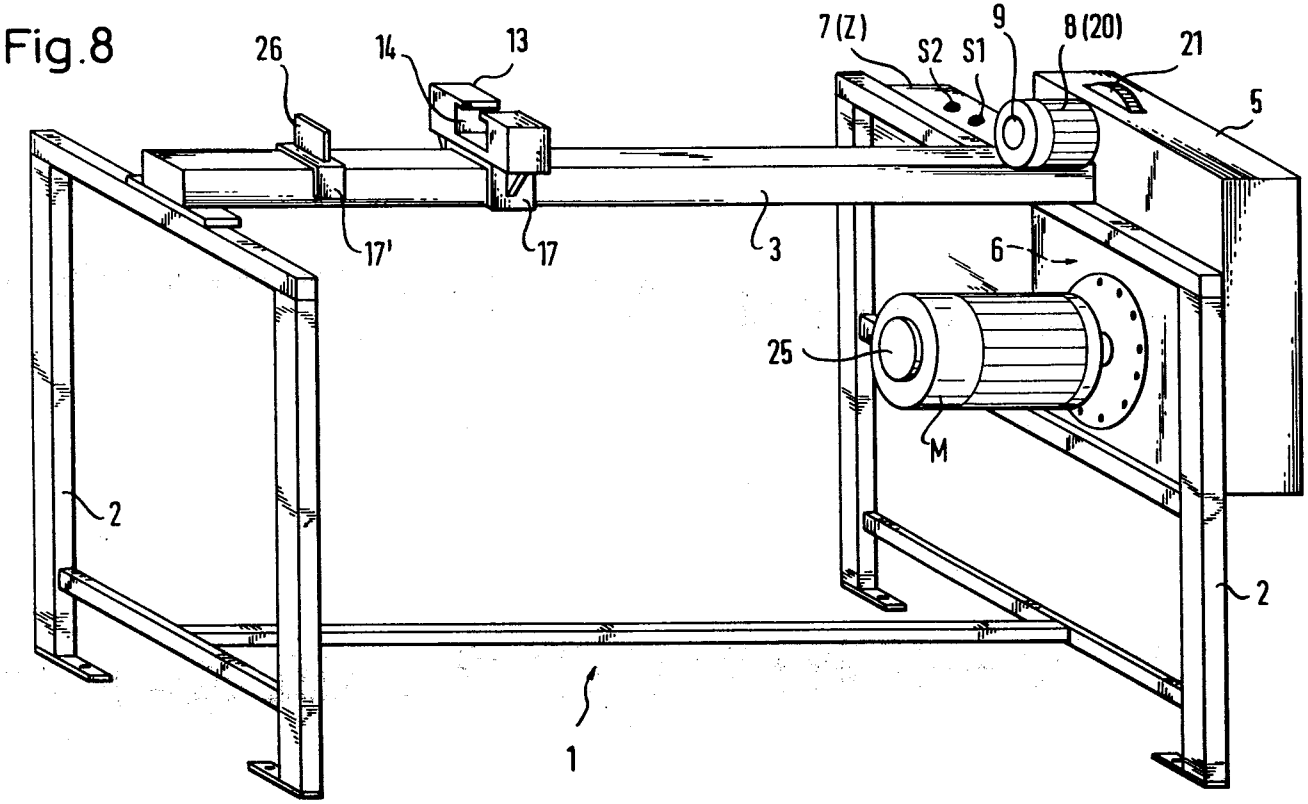

FIGS. 4*a*, 4*b* and 4*c* show front views of profiled insets for the fixture shown in FIG. 3, FIG. 5 is a simplified front view of a twisting disk, FIGS. 6*a*, 6*b* and 6*c* show front views of matching pieces for the twisting disk of FIG. 5, FIG. 7 is an electric block diagram of an apparatus control, FIG. 8 is a perspective view of another embodiment of an apparatus according to the invention, FIG. 9 is a partly sectional, simplified side view of a bending device, FIG. 10 is a top view of the bending device shown in FIG. 9, FIG. 11 is an exploded perspective view of a twisting disk and an associated twirler, and FIG. 12 shows a partly sectional, simplified front view of the housing portion for a twisting disk including a backing-up device.

DETAILED SPECIFICATION

Figure 1:
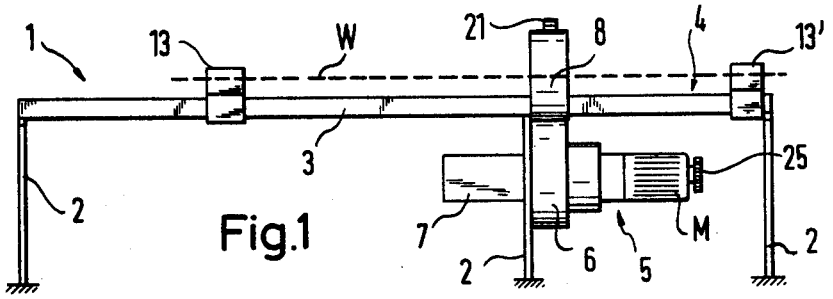
FIG. 1 is a simplified side elevation of an apparatus for cold working bar stock.
Figure 2:
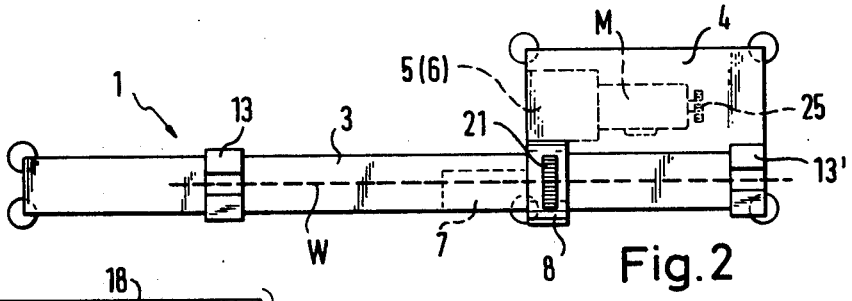
FIG. 2 is a top view of the apparatus shown in FIG. 1.

In the embodiment shown in the simplified drawings of FIGS. 1 and 2, an apparatus or machine 1 comprises pillars 2 supporting a base or bed 3 that is continued by a table 4 which supports a drive assembly or power box 5 housing a stepdown gear 6 and a control unit 7. The drive assembly 5 includes a motor M driving a twisting disk 8 via the step-down gear as controlled. The twisting disk 8 is a rotary fixture designed to receive a work piece W as shown by a dashed line. Depending upon the length and desired shape of this work piece W it will be gripped in at least one of two stationary fixing devices 13,13′ as well as in the rotary fixture comprising the twisting disk 8 whose conrolled rotation results in the desired twisting operation. Motor M is provided with a handwheel 25 fo manually advancing and moving backward the twisting disk 8 after completion of the cold working operation in order to facilitate the removal of the work piece W from the machine 1, individual parts of which are shown in FIGS. 3 to 6.

Figure 2A:
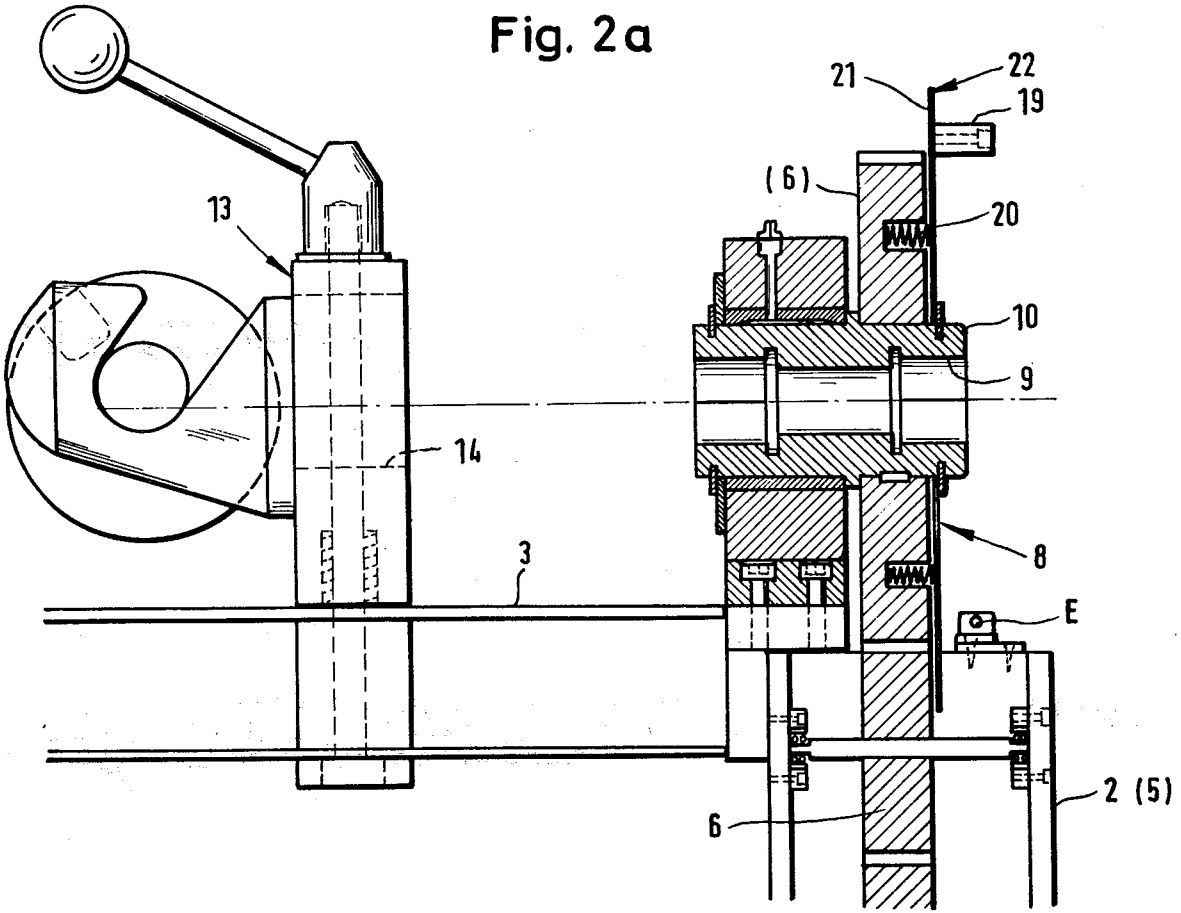
FIG. 2*a* is a sectional view showing the design of the twisting disk.

FIG. 2*a* is a sectional view showing the design of the twisting disk 8 including the frictional coupling 20 by means of compression springs seated in the topmost gear 6 and including the arrangement of cam 19 and limit switch E.

It wll be seen from FIG. 3 that the stationary fixing devices 13,13+ may be designed as carriages having a square yoke aperture 14 for receiving profiled insets 15*a*,15*b*,15*c* (FIGS. 4*a*,4*b*,4*c*), respectively, with sockets 16*a*,16*b*,16*c* of various sections, the profiled insets 15 being adapted to be positively retained in the yoke aperture 14. The stationary fixing devices 13,13′ are provided with legs 17,17′, thus forming a saddle adapted to slidingly ride on the bed 3 and to be locked thereto at any desired position by means of a set screw 27. At its top, each fixing device 13,13′ has an opening corresponding to the maximum width of the bar stock to be worked which is identical to the maximum width of any one of the sockets 16. In case large forces or torques become effective during the cold working operation, the yoke legs are prevented from diverging by means of a grip holder 18 spanning the respective fixture 13,13′. Where necessary, this grip holder 18 can also be fixed by means of a set screw (not shown). Alternatively, the yoke legs along or with the grip holder 18 attached may be secured by a through bolt (not shown).

It will be evident from FIG. 4*a* that socket 16*a* of profiled inset 15*a* is adapted to receive work pieces W or bars which at least have ends of square or rectangular section. Flat bars will be positively held in sockets of type 16*b* in profiled insets 15*b* (FIG. 4*b*). If the bar to be worked has a polygonal profile at least at its ends, a profiled inset 16*c* with a socket 15*c* may be used (FIG. 4*c*). According to the nature of the respective work piece, insets of other profiles may also be used within the scope of the invention. At any rate, the contour of the profiled insets 15 always matches the yoke aperture 14 which may be square, rectangular, V-shaped, polygonal or even circular in section with flat faces. The square shape shown in FIG. 4 is highly desirable because of simple manufacture and solid structure.

An embodiment of twisting disk 8 for an apparatus 1 is shown in FIG. 5. This twisting disk 8 contains coaxially an intermediate member 10 having a hexagonal central hole 9 for positively receiving matching pieces 11 (FIG. 6) either from the front or from the rear. A coupling 20 indicated by dashed lines comprises a setting disk 21 with at least one cam 19 and a corrugation or knurling 22 at the periphery. Marks 23 of the setting disk 21 are associated to a scale or graduation 24 in order to adjust cam 19 for a desired angular position determining the time of motor standstill and thus setting the final position of twisting disk 8.

For working bars which have a square section at least at their ends, matching pieces 11*a* are provided which have square inset profiles 12*a* (FIG. 6*a*). Flat or flat-ended bars are retained by matching pieces 11*b* having a narrow inset profile 12*b* (FIG. 6*b*). Hexagonal work pieces will be positively held in matching pieces 11*c* having a corresponding hexagon inset 12*c* (FIG. 6*c*).

The electric wiring of a control system that may be housed in unit 7 of apparatus 1 is shown in FIG. 7. In this system, a definit amount of rotation of twisting disk 8 involving a number of full circles or any part thereof may be selected by use of a counter Z. In the embodiment of FIG. 7, a three-phase drive is provided having a main switch H for the three phases R,S,T so as to supply voltage at motor terminals *u*,*v*,*w* via fuses Si. The motor casing is connected to ground terminal SL. The direction of motor run depends on which one of two contactors P1, P2 is operated by means of associated press button switches S1 and S2, respectively, which are connected to phase T through a normally closed cut-off switch U. Consequently, associated contact pairs k1 or k2, respectively, connect one end of the contactor coil the other end of which is connected to neutral terminal Mp.

Phase T further supplies voltage to a transformer U having a rectifier G at the secondary side to produce a d.c. voltage smoothed by a capacitor C1. By this d.c. voltage, counter Z is operated and reset after operation prior to which counter Z is manually set to the desired amount of rotation of twisting disk 8. A resetting device N and a response device A shunted by a capacitor C2 serve to selectively set the counter Z to zero or to return. In accordance with the invention, a limit switch E actuated by cam 19 will not bring about the standstill of motor M until the preselected amount of rotation of twisting disk 8 has been reached, corresponding to the number of passes of cam 19 at limit switch E. For this purpose, counter Z may be provided with a relay for actuating cut-off switch U at the given time; in addition, this cut-off switch may be manually operated at any time. The drive system may also be stopped by throwing main switch H.

A modified embodiment of the invention is seen in FIG. 8. Apparatus 1 is supported by pillars 2 and comprises a beamshaped bed 3 carrying a stop 26 as well as a fixing device 13 designed as a yoke carriage. Legs 17' and 17 of the respective carriages 26 and 13 are adapted to be longitudinally moved along bed 3 and to be locked at suitable positions by means of set screws (not shown). Again, fixing device 13 is provided with a yoke aperture 14 for receiving profiled insets (not shown) having sockets that match the bar stock to be worked. An opposite portion of the latter is retained in the inset profile of a matching piece (not shown) which may be plugged into central hole 9 of twisting disk 8. Here, too, twisting disk 8 comprises a coupling 20 with a setting disk 21 and is in driving connection with motor M through a step-down gear 6 in power box 5 to which one side of motor M is flanged whereas at the other side, a handwheel 25 is provided for advancing or returning the twisting disk 8 in order to facilitate insertion and removal of the work piece. Adjacent to power box 5, there is a control unit 7 comprising a counter Z and various control devices which may be of the type shown in FIG. 7. Press button switches S1 and S2 for forward and reverse run of motor M are indicated.

It will be noted that apparatus 1 is of a very simple design with a minimum of parts. A considerable advantage resides in the fact that conventional clamping or gripping heads, chucks, etc. are dispensed with. Instead, the central hole 9 of twisting disk 8 is adapted to receive different profiled insets having, in turn, sockets or recesses snugly fitting the bar to be worked. It is of special importance that the number of revolutions or the rotation angle of twisting disk 8 may be preselected and accurately performed so that the work piece is shaped exactly as desired and may then be easily removed from apparatus 1. As the stationary fixture 13 or 13', respectively, is also designed to detachably receive profiled insets 15, particular stationary chucking devices will not be required, either.

Since central hole 9 passes through twisting disk 8, the bar stock to be worked may be introduced with ease from either side. The opening in the top of each stationary fixture 13,13' permits insertion of the work piece either before or after the opposite bar portion is mounted in twisting disk 8. It is, moreover, possible to first introduce the work piece in the matching pieces 11 and sockets 16, respectively, and then to plug these elements into the rotary and stationary fixtures 8 and 13, respectively, or vice-versa. As indicated in FIG. 1, the stationary fixing device 13 and 13' may be arranged at either side of twisting disk 8 if so desired.

Without any need for monitoring, operation of the apparatus 1 requires merely to preselect the amount of rotation necessary for twisting disk 8 to produce the desired shape. For effecting this preselected amount of rotation, electromechanical or electric control means may be employed for governing motor M such that it stops exactly in the angular position wanted by the operator. For example, it will be normal for bars of regular polygon section that the peripheral faces of the twist-free portions are parallel. In the apparatus according to the invention, this sort of shaping may be preselected and automatically performed. In the embodiment aof FIGS. 1 to 7, the arrangement of setting disk 21 and cam 19 is used for the purpose. Alternatively, a timer may be employed for preselecting the time taken by twisting disk 8 to complete the rotary or angular motion exactly as desired. In both cases, simple control systems may be used requiring but a small number of components and interconnections and safeguarding a maximum reliability. If a timer is used and either the gear ratio or the motor speed is variable, a simple exchange of a structural element or of a few parts may suffice to produce the necessary coordination.

Another feature of the invention is the arrangement of power box 5 and/or control unit 7 either laterally or below bed 3 so that not only apparatus 1 may have a compact, sturdy design but also handling of the bar stock and operation of the machine is not hampered in any way.

For identially working a pluraity of like bars, it may be advantageous to employ the slidingly adjustable stop 26 which is also useful for producing volutes, the length of the bar stock decreasing considerably while it is worked so that it may be expedient to have stop 26 follow either resiliently or by adjustment.

Further in accordance with the invention, inset profiles 12 and sockets 16 may be rounded at least at the forward twist edges so that the transitions between bar portions worked and not worked will be free of nasty (if small) deformations that might require reworking.

An important feature of the invention consists of providing matching pieces 11 at both ends of central hole 9 in twisting disk 8 so that the "lead" or axial pitch of the twisted portions may be reduced down to approximately 1 cm (= 0,4 inches). In contrast to the prior art, it is thus easily possible to produce narrowly twisted bar stock and complicated shapes, e.g. volutes as explained hereinafter.

It will be seen that in accordance with the invention, the receiving openings 12 and 16 of the insertion means 11 and 15, respectively, can be proportioned so as to simultaneously retain at least two work pieces W in each of the fixtures 8,9 and 13,13', respectively. If the instance the insertion means 11,15 are adapted to receive bunches of four square bars positively retained in the inset profiles 12 and sockets 16, respectively, volutes or double-twined twists may be manufactured in a very short time. Hitherto, it was necessary to heat four square bars of equal length, to twist them while warm by about two revolutions, to return-twist them as well as to upset and dress them. Due to the inevitable heat of this process and to the complexitiy of the procedure, this method of manufacture took a long time and, moreover, was frequently unsatisfactory involving high reject rates. Using an apparatus 1, however, uniform volutes may be worked from cold stock within a short period, e.g. 30 sec, free of scrap and trouble.

The apparatus 1 may include a bending device such as shown in FIGS 9 and 10 for manufacturing arched stock with a wide range of curvatures. It will be seen that the slide 28 may ride on bed 3 and may be secured thereto by means of a locking bar 38 or by a similar contrivance. A plug-in profile or dog 31 of a pulling roller 29 may be inserted into central hole 9 of twisting disk 8. The periphery of the pulling roller 29 may bear a corrugation 30. Slide 28 extends to either side of bed 3 and is provided with tracks 32 and 32' carrying fixtures 34 and 34' for bending rollers 33 and 33', respectively, which are supported in blocks 36 and 36' and are adapted to be adjusted by worms 35 and 35' to be operated by handles 37 and 37', respectively. At each side, a setting scale 39 and 39' permits exact positioning of the bending roller 33 and 33', respectively, vis-a-vis the top of slide 28 and thus in relation to pulling roller 29.

In operation, the longitudinally slidable fixtures 34,34' are retreated until there is enough space for introducing straight bar stock between the bending rollers 33,33' on the one hand and the pulling roller 29 on the other hand. Then the pulling roller 29 is slowly rotated, for example in the direction of the arrow of FIG. 9, and the bending rollers 33,33' are moved upward either singly or together so that the bar stock is bent during every passage as indicated by phantom lines in FIG. 9. It will be seen that for unidirectional feeding of bar stock to be bent, an asymmetrically toothed corrugation 30 as provided by the invention is advantageous.

The top view of the bending device represented in FIG. 10 also shows two separate worms 35 and 35'. However, the invention contemplates using a common drive consisting of two interconnected opposite worm drives for simultaneous positioning of the bending rollers 33,33' relative to the pulling roller 29. In this case, each worm may carry a nut vertically guiding a dog member that may slide along the associated inclined track 32 and 32', respectively, and that may constitute or guide the respective bending roller fixture 34,34'.

Still another embodiment of the invention is shown in FIGS. 11 and 12. A twirler 40 having a plug-in profile or stud 41 of suitable shape may be positively retained in the central hole 9 of twisting disk 8. As illustrated, twirler 40 may comprise a receiver disk 42 connected to an interchangeable base disk 43 by means of keying 44 and by a securing screw 45. Base disk 43 is integral with or rigidly connected to a plying tool 46 for twirling the bar stock as desired. Also, base disk 43 supports a freely rotatable corrugated excenter 47 inside the plying tool 46.

In operation, the bar stock loosely introduced between excenter 47 and plying tool 46 is automatically clamped by excenter 47 as soon as twirler 40 is rotated by twisting disk 8. Bemding or plying is effected if the free bar end is backed up, e.g. on a stud bolt 52 (FIG. 12) attached to a frame support 51 by means of a knurled screw 53. Frame support 51 may be secured to a block 50 pillowing the twisting disk 8 or to the machine bed 3. When twirler 40 is stopped and, where necessary, slightly turned back, excenter 47 normally releases the bent stock. If this should not occur, a suitable tool may be inserted in a socket 48, such as the hexagon socket shown, for loosening excenter 47.

The bending shape is determined by the contour of plying tool 46. As important advantage of the invention resides in the fact that by simply changing base disk 43, another plying tool 46 will become operative in a very short time. In contrast to conventional apparatus, each plying tool 46 in accordance with the invention has its own invariable contour so that any number of uniform twirled parts of exactly the same shape may be manufactured. In addition, the twirler 40 thus has a maximum service life.

While the principles of the invention have been described above by explaining specific examples it is to be clearly understood that this description may not be construed as a limitation to the scope of the invention as set forth in the objects thereof and in the accompanying claims.

I claim:

1. An apparatus for the cold working of bar stock, comprising a bed support stationary fixing means and comprising rotary fixing means motor-driven via a step-down gear, said stationary and rotary fixing means being aligned and arranged for variable spacing with respect to each other and being provided each with detachable insertion means having a profile matching that of the bar stock to be worked, control means being provided fo effecting a predetermined amount of rotation of said rotary fixing means relative to said stationary fixing means, whereby one bar portion is held stationary while an opposite bar portion is wound in predetermined degree.

2. Apparatus according to claim 1, wherein said rotary fixing means include a chuck disk with a shaped central hole for receiving said detachable insertion means.

3. Apparatus according to claim 2, wherein said detachable insertion means comprise matching pieces each having a through hole matching the bar stock to be worked and further having a peripheral configuration matching the shape of said central hole.

4. Apparatus according to claim 2, wherein the shape of said central hole is a polygon.

5. Apparatus according to claim 1, wherein said stationary fixing means include a yoke aperture for receiving said detachable insertion means.

6. Apparatus according to claim 5, wherein said detachable insertion means comprise profiled insets having sockets matching a bar to be twisted and further having a peripheral configuration matching the shape of said yoke aperture.

7. Apparatus according to claim 5, wherein said bed supporting said stationary fixing means is substantially beam-shaped, and wherein said stationary fixing means comprise a carriage slidingly adjustable along said generally beam-shaped bed, said carriage consisting of a saddle positively riding on said bed and of an upper portion including said yoke aperture, locking means being provided for securing said saddle to said bed in a selected position thereto.

8. Apparatus according to claim 5, wherein the top of said detachable insertion means has an opening as wide as one dimension of the bar stock to be worked.

9. Apparatus according to claim 5, wherein a grip holder is provided for clamping said stationary fixing means when said detachable insertion means hold a bar to be worked.

10. Apparatus according to claim 6, said detachable insertion means having rounded edges in said profile at the side facing the bar twists, the contour of said rounded edges following the twisting curve.

11. Apparatus according to claim 3, wherein matching pieces are arranged at both ends of said central hole in said rotary fixing means.

12. Apparatus according to claim 1, said detachable insertion means being designed to simultaneously receive a plurality of bars.

13. Apparatus according to claim 12, wherein said detachable insertion means are adapted to positively receive a bunch of four bars of square section for twisting volutes.

14. Apparatus according to claim 1, wherein a slidingly adjustable stop riding on said bed is provided beyond said stationary fixing means, said stop being adapted to abut the free end of said bar stock during the working operation.

15. Apparatus according to claim 13, wherein a slidingly adjustable stop riding on said bed is provided beyond said stationary fixing means, said stop being adapted to abut the free end of said bar stock during the working operation.

16. Apparatus according to claim 14, wherein said stop includes a saddle positively riding on said bed and locking means for securing said saddle to said bed in a selected position thereto.

17. Apparatus according to claim 1, wherein said control means comprise electromechanical means governing said motor drive for said rotary fixing means.

18. Apparatus according to claim 1, wherein selection means are provided for selecting said predetermined amount of rotation of said rotary fixing means.

19. Apparatus according to claim 18, wherein said control means are adapted to respond only to said selection means being set for a predetermined amount of rotation.

20. Apparatus according to claim 19, said rotary fixing means including at least one cam for actuating a limit switch upon completion of said predetermined amount of rotation of said rotary fixing means, the actuation of said limit switch stopping said motor drive.

21. Apparatus according to claim 20, wherein said cam is arranged for adjustment in a circumferential direction of said rotary fixing means.

22. Apparatus according to claim 20, wherein coupling means are provided for adjustably supporting said cam, said coupling means being adapted to be locked to said rotary fixing means in a selected position relative thereto.

23. Apparatus according to claim 22, wherein said coupling means comprise a setting disk associated to said rotary fixing means and arranged for controlled angular positioning relative thereto.

24. Apparatus according to claim 23, wherein markings are provided for controlling the angular adjustment between said setting disk and said rotary fixing means.

25. Apparatus according to claim 23, wherein said setting disk has a corruguated circumference for manual adjustment thereof.

26. Apparatus according to claim 23, wherein coaxial bearing means are provided in said rotary fixing means for supporting said setting disk relative thereto, spring means being arranged for axial bias between said setting disk and said rotary fixing means.

27. Apparatus according to claim 20, wherein a relay circuit is provided that is adapted to be operated, by means of separate controls, for forward and reverse run of said motor drive, a circuit breaker being provided for effecting the stop of said motor drive upon the final preselected actuation of said limit switch by said cam.

28. Apparatus according to claim 27, wherein said limit switch and said circuit breaker are mechanically coupled.

29. Apparatus according to claim 27, wherein resetting means are provided for said relay circuit.

30. Apparatus according to claim 18, said selection means comprising a counter.

31. Apparatus according to claim 1, wherein said control means include timing means for selecting and effecting said predetermined amount of rotation of said rotary fixing means.

32. Apparatus according to claim 31, wherein said timing means comprise a timer having interchangeable control elements for adaptation of said predetermined amount of rotation to the speed of said motor-driven gear.

33. Apparatus according to claim 1, wherein a handwheel is provided at the shaft of said motor for manually advancing and moving backward said rotary fixing means.

34. Apparatus according to claim 1, said control means being arranged laterally in respect of said supporting bed.

35. Apparatus according to claim 2, wherein a bending device is provided comprising a slide mounted on said bed, said slide supporting two bending rollers for conrolled spacing therebetween, means being provided for vertically adjusting said bending rollers relative to a pulling roller, the latter having insertion means positively matching said central hole, said pulling roller being adapted to cooperate with said bending rollers for gripping and cold working a bar therebetween.

36. Apparatus according to claim 35, said slide comprising at each side of said bed an inclined track directed towards said pulling roller, each track supporting a fixture for pillowing the associated bending roller, each fixture including a worm drive for adjusting the height and spacing of said bending rollers relative to each other and to said pulling roller.

37. Apparatus according to claim 35, wherein the circumference of said pulling roller is corrugated.

38. Apparatus according to claim 2, wherein twirler means are provided comprising a plug-in profile matching said central hole, said twirler means including an eccentric clamp comprising a rotatably mounted, corrugated eccentric cam adjacent which at least one plying tool is rigidly connected to said twirler means.

39. Apparatus according to claim 38, said twirler means consisting of a receiver disk bearing said plug-in profile and of a base disk interchangeably secured to said receiver disk.

40. Apparatus according to claim 39, wherein keying and locking means are provided for detachably interconnecting said receiver and base disks.

41. Apparatus according to claim 39, wherein support means are provided for holding backing-up means such that the latter extend substantially parallel to the axis of rotation of said twirler means at a given radial distance thereto.

42. Apparatus according to claim 39, wherein said base disk is integral with said plying tool inside which siad eccentric cam is supported for free rotation so as to jam a bar to be worked upon rotary movement of said twirler means.

* * * * *